US005114602A

United States Patent [19]

Petrille et al.

[11] Patent Number: 5,114,602

[45] Date of Patent: May 19, 1992

[54] LUBE OIL DISPERSANT BORATING AGENT

[75] Inventors: Dennis G. Petrille; Herbert S. Golinkin, both of Naperville, Ill.

[73] Assignee: Amoco Corporation, Chicago, Ill.

[21] Appl. No.: 649,037

[22] Filed: Jan. 31, 1991

[51] Int. Cl.[5] ..... C10M 133/44

[52] U.S. Cl. ..... 252/51.5 R; 252/51; 564/8; 548/405; 548/546

[58] Field of Search ..... 564/8; 548/405, 546; 252/51.5 R, 51

[56] References Cited

U.S. PATENT DOCUMENTS

| | | | |
|---|---|---|---|
| 3,718,663 | 2/1973 | Piasek et al. | 548/405 |
| 4,702,851 | 10/1987 | Wollenberg | 548/405 |
| 4,840,744 | 6/1989 | Wollenberg et al. | 252/51.5 R |
| 4,925,983 | 5/1990 | Steckel | 44/317 |

FOREIGN PATENT DOCUMENTS

| | | | |
|---|---|---|---|
| 2755199 | 6/1979 | Fed. Rep. of Germany | 44/317 |

*Primary Examiner*—Brian E. Hearn
*Assistant Examiner*—Maria Nuzzolillo
*Attorney, Agent, or Firm*—Matthew R. Hooper; William H. Magidson; Frank J. Sroka

[57] ABSTRACT

A borated bis succinimide, containing a high level of boron (preferably 1.0 to 3.0 wt. percent) is prepared by heat reacting a corresponding bis succinimide in mineral oil solution with boric acid and water at an elevated temperature of at least about 177° C. Superborated succinimides prepared in the foregoing manner are useful as borating agents for ashless nitrogen containing dispersants. Lubricating compositions which incorporate nitrogenous ashless dispersants borated with the superborated succinimide of the present invention show reduced tendency to degrade engine seals manufactured from fluorine containing elastomers.

4 Claims, No Drawings

LUBE OIL DISPERSANT BORATING AGENT

BACKGROUND OF THE INVENTION

1. Field of the Invention

This invention relates generally to lube oil dispersant borating agents, and more particularly, to superborated succinimides and a method for production thereof. The use of the superborated succinimide of the present invention as a borating agent for nitrogen containing lube oil dispersants results in improved lubricating additive compositions in which the known tendency to degrade engine seals made from fluorine-substituted elastomers is substantially reduced.

2. Background Discussion

It is known, as illustrated by U.S. Pat. No. 3,338,834, that alkyl succinic anhydride can be reacted with tertiary-alkyl primary amines to form a monosuccinimide which can be combined with a boron containing reagent (via a boric acid-amine reaction product in this patent) to provide an additive which is useful in ashless detergent additives in lubricating oils. The alkyl succinimides are prepared by reacting alkyl-succinic anhydride with a polyamine, typically tetraethylene pentamine, in equimolar proportions to produce a monosuccinimide.

It is also known from U.S. Pat. Nos. 3,385,791, 3,703,536 and 3,718,663 that di(alkyl succinimides) of $N_1,N_3$-symmetrical bis (aminopolyazalkylene) ureas of the formula:

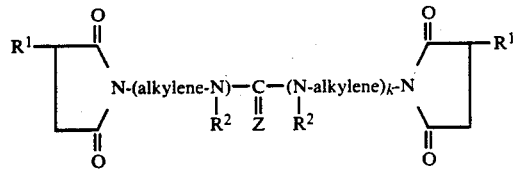

wherein k is an integer of about 2 to about 10, $R^2$ is hydrogen or a lower alkyl group having one to four carbon atoms, $R^1$ is an alkyl group containing from 30 to 20,000 carbon atoms, and Z is oxygen or sulfur, may be prepared by condensing an alpha, omega aminopolyazalkylene compound with urea or thiourea and then reacting the condensation product with a light oil solution of an alkyl substituted succinic anhydride in an amount to provide 2 moles of the alkyl substituted succinic anhydride product. The '536 and '663 patents disclose that the di(alkyl succinimides) of the above formula may be borated or "superborated" with aqueous boric acid to produce a product which is useful as an ashless dispersant-detergent boration agent for lubricating oils. The temperature of the borating or superborating reaction is between about 180° and 220° F. (82° and 104° C.).

While the use of ashless dispersants in lubricants has long been known to maintain engine cleanliness, boron has also been incorporated to inhibit corrosion on copper-lead bearings in the ASTM L-38 engine test, to reduce wear in the ASTM Sequence V engine test, and to reduce the well known tendency of nitrogen containing dispersants to degrade fluorine based elastomeric engine seals (see e.g. U.S. Pat. No. 4,873,009) The present invention stems from our discovery that the source of the boron and its means of incorporation can have an effect upon the passivation of dispersant-containing lubricants toward the degradation of seals made from fluorine-substituted elastomers, and that the superborated succinimides of this invention are uniquely superior as borating agents for that purpose.

SUMMARY OF THE INVENTION

The present invention is a borated succinimide which can be represented by the formula:

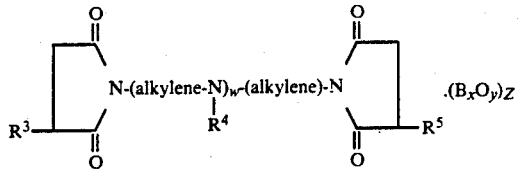

wherein $R^3$ and $R^5$ are independently alkyl groups containing about 20 to 165 carbon atoms, the alkylene groups each independently contain 2 to 8 carbon atoms each, $R^4$ is independently hydrogen or alkyl containing 1 to 4 carbon atoms, w is a member having a value of zero to 6, x is a member having a value of 1 to 3, y is a member having a value of 1 to 3, and where Z is an integer having a value of 2 to 56; said borated succinimide having a boron-to-nitrogen weight ratio of about 0.20 to 65.

Preferably, for better overall dispersancy, $R^3$ and $R^5$ have number average molecular weights in the range of about 900 to about 3000, and most preferably in the range of about 1200 to about 2300, corresponding, respectively, to about 65 and about 85 carbon atoms in the alkyl groups. The value of w can be in the range of 1 to 4 and most preferably 2 to 4.

While substantially all of the aforesaid alkyl groups have the general formula $C_nH_{2n+1}$, some of the hydrogen atoms in the formula may be replaced by chlorine as an incident to the production of the alkyl succinic anhydride starting material.

The borated bis(alkyl succinimide) borating agent of this invention is prepared by heat reacting bis(alkyl succinimide) in mineral oil solution with a mixture of boric acid and water. After the bulk of the water of reaction has been removed by distillation, the reaction can be carried out at a temperature sufficiently high that preferably at least about 80% of the boron used is incorporated into the reaction product.

The superborated succinimide of the present invention preferably has a boron concentration of about 1.0 to about 3.0 weight percent. As such, it is used as an agent to incorporate boron into ashless dispersants which do not contain boron. This can be accomplished by blending the superborated succinimide of the invention with a conventional nitrogenous ashless dispersant and mineral oil diluent to obtain an ashless dispersant of desired activity and boron content.

DETAILED DESCRIPTION

The starting material for making the borated succinimide of this invention is a succinimide having the general formula:

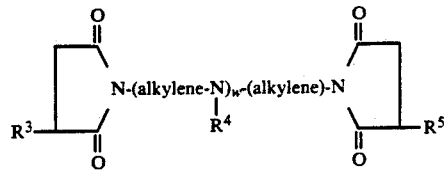

in which $R^3$ and $R^5$ are long chain alkyl groups containing about 20 to 165 carbon atoms, the alkylene groups each contain 2 to 8 carbon atoms, $R^4$ is hydrogen or an alkyl group containing 1 to 4 carbon atoms, and w is an integer having a value of zero to 6.

Suitable succinimides are prepared by heat reacting each mole of a polyalkylene polyamine containing two primary amine groups with two moles of an alkyl-substituted succinic anhydride. The polyalkylene polyamine can be pure, having the formula $$H_2N(\underset{\underset{R^4}{|}}{R}N)_nR-NH_2,$$

wherein each R is an alkylene group having from 2 to 8 carbon atoms and $R^4$ is hydrogen or alkyl containing 1 to 4 carbon atoms. However, most of these compounds available in commerce are a mixture of polyalkylene polyamines containing up to about 5, preferably 1–4, and most preferably 2 or 3 secondary amine groups. Commercial polyalkylene polyamines also can contain piperazine units of the structure:

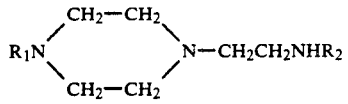

where $R_1$ and $R_2$ can be H, 1–4 alkyl or 2–8 alkylene. The amount of the anhydride can vary, and can extend from about 1.5 moles to about 2.5 moles per mole of the polyamine while still producing a significant proportion of the desired bis-imide. The imidation reaction itself is conventional.

The boration reaction is preferably carried out at an elevated temperature of at least 182° C. in order that the bis-(alkyl succinimide) will take up at least about 80% of the boron introduced into the reaction mixture within a reasonable period of time. When high boron absorption is achieved, providing a boron content of the product in the range of about 1.0 to about 3.0%, preferably about 1.5% to about 2.5%, and most preferably about 1.9% to about 2.1%, lubricants which utilize the highly borated product in combination with other non-borated dispersants exhibit minimal degradation of seals made from fluorine-substituted elastomers, and their performance is superior to that obtained using other sources of boron. Borated products of high boron content are sometimes referred to in the art as "superborated," and, in keeping with convention, such language is sometimes used herein. Although such superborated materials can also be correctly referred to as succinimide dispersants, these materials are used in the present invention primarily as borating agents for lubricating compositions which contain other nitrogenous dispersant compositions, and at levels generally well below the amounts of said other dispersants.

Referring more particularly to the boration reaction, it involves first combining the bis(alkyl succinimide), boric acid, water and sufficient diluent oil to provide the desired concentration, and then heating the resulting mixture under an inert atmosphere sparge to a sufficient temperature and maintaining that temperature for a sufficient time to incorporate the boron into the product. The boration reaction is accompanied by elimination of water from the boric acid, and distillation of water from the reaction mixture.

The superboration process can be conducted at temperatures in the range of about 177° C. to about 260° C., preferably about 182° C. to about 218° C., and most preferably about 182° C. to about 193° C. The time for the process is about one hour to twenty-four hours, preferably about two hours to about five hours, and most preferably about three hours to about four hours. When the reaction temperature is somewhat below 182° C., e.g., 177° C., the boron incorporation is marginally satisfactory; however, increasing the reaction time from four to twenty-four hours does not increase the boron incorporation greatly. On the other hand, increasing the temperature to 191° C. increases the boron incorporation by ten to fourteen percent. Further increase of temperature to a temperature in the range of 204° to 260° C. does not increase the amount of boron incorporated.

The super borated bis-succinimide of this invention is useful as a borating agent for boration of nitrogenous ashless dispersants used in internal combustion engine lubricants.

The incorporation of boron into a non boron containing ashless dispersant is carried out by blending the superborated succinimide with the non borated ashless dispersant and sufficient diluent mineral oil to produce a desired boron concentration in the final product. Suitable dispersant compositions contain about 7 to about 235 parts by weight of borated succinimide per 100 parts of a mixture of diluent oil plus unborated ashless dispersant mineral oil lubricant. The temperature of blending is sufficiently high to render the viscosity of the mixture low enough for easy mixing. This generally requires a temperature in excess of about 38° C. and lower than 260° C., preferably between a temperature in the range of about 93° C. to about 177° C. The blending is conducted under an inert atmosphere for a sufficient time to produce a uniform product, generally from two to twenty-four hours.

The beneficial effect of boron incorporation via the borating agent of the present invention can be ascertained from data obtained to show the effect of the boron in degradation of Viton ® engine seals using the so-called VW P3334 Viton Test. This test is used to determine the susceptibility of the Viton ® elastomer to degradation by lubricant. Viton ® is a fluoroelastomer based on the copolymer of vinylidene fluoride and hexafluoropropylene. It is used in gaskets, seals, diaphragms and tubing in aerospace and automotive components where resistance to chemicals, corrosive liquids and solvents are required.

In the noted Viton ® Test, the lubricant contains the ashless dispersant as well as other additive components useful in an internal combustion engine. The test is conventional except for the boron-contributing component. The other additives and their incorporation into the lubricant are well known in the lubricant industry, and in practice these may include, but are not limited to, detergents, wear inhibitors, oxidation inhibitors, friction modifiers, alkylated zinc dithiophosphates, and viscosity index improvers blended into a mineral and/or synthetic base oil.

The lubricant, in a covered container containing samples of the elastomer, in standard "dogbone" shapes as specified in ASTM Standard D-412, is immersed in the lubricant, is heated in an oven to 150° C. and maintained at that temperature for four days. The elastomer samples are then removed and dried, and the tensile modulus of the specimens is determined according to the procedure of ASTM Standard D-412. The tensile modulus is then compared to that of elastomer specimens which were not heated in any oil. The percent change in the tensile modulus due to immersion in the oil, i.e. the "delta", is noted.

A similar test in which the elastomer specimens are immersed in the oil and subjected to a temperature of 150° C. for ten days, and compared to elastomer specimens immersed in a reference oil, is known in the industry as the Caterpillar Viton® test.

As will be illustrated hereinafter, incorporation of boron into an ashless nitrogen containing dispersant using the super borated bis-succinimide of this invention decreases the tendency of a lube oil containing the borated dispersants to degrade the Viton® elastomer.

Throughout this application, all proportions, percentages and the like are by weight, unless otherwise stated. The following examples describe the implementation of the various aspects of this invention.

EXAMPLE 1

Preparation of Bis Succinimide

An appropriate reaction vessel equipped with means for heating, stirring and sparging with nitrogen is charged with 7,500 grams of a 60% solution of polyisobutyl succinic anhydride having a number average molecular weight of 2250 in mineral oil. The vessel is also charged with 2,922 grams of mineral oil having a viscosity of about 100 SUS at 40° C. The vessel is then further charged with 189 grams tetraethylene pentamine. The mixture is heated to a temperature of about 145° C. to 175° C. while stirring and sparging with nitrogen gas. This temperature is maintained for a period of two to four hours such that about 36 grams (2.0 moles) water is eliminated producing a 44% solution of a bis succinimide in mineral oil.

EXAMPLE 2

Using the apparatus of Example I, the vessel is charged with 4,333 grams of a 60% solution of polyisobutyl succinic anhydride having a number average molecular weight of 1,300 in mineral oil. The vessel is then charged with 1,020 grams mineral oil having a viscosity of about 100 SUS at 40° C. followed by 189 grams tetraethylene pentamine. The mixture is heated to about 145° C. to 175° C. while it is stirred and sparged with nitrogen gas. This temperature is maintained for a period of two to four hours during which about 36 grams of water are eliminated producing a 50% solution of bis succinimide in mineral oil.

EXAMPLE 3

Preparation of Borated Bis(Alkyl Succinimide)

An appropriate reaction vessel equipped with means for heating, stirring, sparging with an inert atmosphere, an addition port and a water cooled condenser, is charged with 500.0 grams of the 44% solution of a bis succinimide in mineral oil produced in Example 1 and with 265.6 grams of mineral oil having a viscosity of about 100 SUS at 40° C. The mixture is heated with stirring to about 90° C. to 100° C., and the reaction vessel is further charged with 160.8 grams of boric acid and 80.0 grams of water. The mixture is heated under nitrogen sparge to about 100° C. and held at that temperature until about 35 ml to 70 ml of distillate is collected. The mixture is then heated to about 177° C. and held at that temperature for three hours. Approximately 150 grams of additional distillate is collected. The reaction product is then filtered using diatomaceous earth filter aid. The product is a clear, dark amber, viscous liquid having the elemental analysis shown below.

| Element | Elemental Analysis Calculated Value | Measured Value |
|---|---|---|
| Carbon | 79.57% | 80.01% ± 0.12% |
| Hydrogen | 13.32% | 12.97 ± 0.03% |
| Nitrogen | 0.355% | 0.347% ± 0.007% |
| Boron | 2.00% | 2.18% ± 0.06% |

EXAMPLES 4–15

High Temperature Preparation of Borated Bis(Alkyl Succinimides)

Syntheses are conducted in the manner of Example 2 using charges of reactants (grams) and conditions of time and temperature as specified in Table I below. In the examples below of Table I, boron incorporation is calculated as follows:

$$\frac{(\%\ \text{B in product})\ [\text{mass boric acid } (0.563) + \text{mass oil} + \text{mass succinimide}]}{(\text{mass boric acid})\ (0.1748)\ (100)}$$

TABLE I

| Ex. | Bis-Imide | Oil | Boric Acid | Water | °C. | Hrs. | B % of Mass | B % of B in Feed |
|---|---|---|---|---|---|---|---|---|
| 4 | 309.5 | 29.5 | 91.7 | 0 | 160 | 4 | 1.30 | 32 |
| 5 | 309.5 | 79.5 | 91.7 | 45.9 | 163 | 4 | 1.90 | 53 |
| 6 | 309.5 | 79.5 | 91.7 | 45.9 | 177 | 4 | 2.22 | 62 |
| 7 | 258.5 | 145.0 | 91.6 | 45.8 | 177 | 4 | 1.90 | 54 |
| 8 | 259.0 | 158.0 | 52.0 | 26.0 | 177 | 4 | 1.55 | 78 |
| 9 | 258.0 | 158.0 | 52.0 | 26.0 | 177 | 24 | 2.63 | 82 |
| 10 | 258.0 | 158.0 | 52.0 | 26.0 | 191 | 5 | 1.83 | 92 |
| 11 | 279.0 | 123.0 | 91.7 | 45.8 | 191 | 5 | 2.60 | 74 |
| 12 | 258.0 | 166.8 | 61.1 | 30.6 | 204 | 3 | 1.81 | 78 |
| 13 | 258.0 | 166.8 | 61.1 | 30.6 | 218 | 3 | 1.79 | 77 |
| 14 | 258.0 | 166.8 | 61.1 | 30.6 | 232 | 3 | 1.90 | 92 |
| 15 | 258.0 | 166.8 | 61.1 | 30.6 | 260 | 3 | 1.78 | 77 |

EXAMPLE 16

Preparation of Borated Bis Succinimide

The apparatus of Example 3 is charged with 440 grams of the solution product of Example 2 and 383.3 grams of a mineral oil having a viscosity of about 100 SUS at 40° C. The mixture is heated with stirring to about 90° C. to 100° C., and the reaction vessel is charged with 118.5 grams of boric acid and 59.2 grams of water. The mixture is heated under nitrogen sparge to about 110° C. and held at that temperature until about 25 ml to 50 ml of distillate is collected. The mixture is heated to about 177° C. and held at that temperature for three hours. Approximately 103 ml distillate is collected. The mixture is filtered using diatomaceous earth filter aid. The product is a clear, amber, viscous liquid having a boron content of 2.0%.

EXAMPLE 17

Boration of an Ashless Dispersant

A suitable reaction vessel equipped with means for heating, stirring and inert atmosphere blanketing is charged with 374.7 grams of the solution product of Example 1, 62.5 grams of the borated solution product of Example 3 and 16.8 grams of an oil having a viscosity of about 100 SUS at 40° C. The mixture is blanketed with an inert atmosphere, and heated to about 104° C. with stirring and the temperature is maintained for about four hours. The product is a clear, amber, viscous liquid having a boron content of 0.300% (which matches the calculated value). The nitrogen content is 0.552% which can be compared to the calculated percentage of 0.568%.

EXAMPLE 18

Boration of Ashless Dispersant at Elevated Temperature

The same procedure as Example 17 except the reaction mixture is heated to about 160° C. while stirring and blanketing with an inert atmosphere. The temperature of about 160° C. is maintained for about 24 hours.

EXAMPLE 19

VW Viton Test

A suitable blending vessel equipped with means for heating and stirring is charged with 93.6 grams of the solution product of Example 1 and 1506.4 grams of a standard oil blend 'A' containing components suitable for an internal combusion engine, but excluding the ashless dispersant. The mixture is heated to about 71° C. with stirring, and maintained at that temperature for about one hour. About 500 ml of the mixture is placed in each of four 600 ml double lipped beakers. Four dogbone specimens of Viton® elastomer, supported on a wire hanger suspended from a glass rod, are placed in each of the beakers which is covered with a petri dish and placed in an oven at 150° C. where they are kept for four days. After four days the beakers are removed from the oven, cooled, and the elastomer specimens are wiped with a paper towel to remove the excess oil. The modulus of the specimens at 33.3% elongation is measured, and averaged over the four specimens. The result is compared to the value for untested elastomer specimens and average % change from the three beakers is reported as "delta" in Table II below. An oil is determined to pass this test if "delta" is no larger than 25% and the specimens are free of cracks.

EXAMPLE 20

VW Viton Test

The procedure of Example 19 is repeated except 93.6 grams of the ashless dispersant product of Example 17 is blended with 1506.4 grams of oil blend 'A'. The test results are reported in Table II, below.

EXAMPLE 21

Boration of Ashless Dispersant

The procedure of Example 17 is repeated except 374.7 grams of a succinic amide ester ashless dispersant, 41.7 grams of the borated solution product of Example 3 and 83.6 grams of an oil having a viscosity of about 100 SUS at 40° C. are charged to the reaction vessel.

EXAMPLE 22

VW Viton Test

The procedure of Example 19 is repeated except 88.0 grams of a succinic amide ester ashless dispersant obtained in accordance with U.S. Pat. No. 4,4873,009, is blended with 1512.0 grams of a standard oil 'B'. The test results are reported in Table II, below.

EXAMPLE 23

VW Viton Test

The procedure of Example 22 is repeated except the succinic amide ester ashless dispersant is replaced by the product of Example 21. The test results are reported in Table II, below.

TABLE II

| VW VITON TEST | | | | |
|---|---|---|---|---|
| Ex. | Dispersant | Boron Con. | Oil | Delta or % Change |
| 19 | Bis-imide | None | 'A' | 9.2% |
| 20 | Bis-imide | 0.3% | 'A' | 8.8% |
| 22 | Succinicamide ester | None | 'B' | 23.4% |
| 23 | Succinicamide ester | 0.4% | 'B' | 13.4% (11.2)%* |

(*Repeat of the test)

EXAMPLE 24

Caterpillar Viton® Test

A suitable blending vessel equipped with means for heating and stirring is charged with 35.0 grams of the solution product of Example 1 and 465.0 grams of a standard oil 'C' containing all the components essential for its efficacy to perform in an internal combustion engine except for the ashless dispersant. The mixture is heated to about 71° C. with stirring, and maintained at that temperature for about one hour. About 150 ml of the mixture is placed in each of three cylindrical glass containers. Three dogbone specimens of Viton® elastomers, separated from one another by suitable glass spacers, are placed in each of the cylinders so that they are totally submerged in the oil. The cylinders are stoppered with aluminum clad corks, and placed in an oven at 150° C. where they are kept for ten days. Three additional cylinders are similarly prepared containing elastomer specimens immersed in a reference oil. After ten days the cylinders are removed from the oven. The elastomer specimens are removed from the cylinders and allowed to cool while draining into a paper towel. They are then wiped dry, and cooled to room temperature. The ultimate tensile strength of the elastomer specimens is determined according to the procedure of ASTM D-412 using a grip separation rate of 8.5 plus or minus 0.8 mm/sec. The average elongation for the three dumb bell specimens in a cylinder is obtained and is compared to that of the untested elastomer to give a % change in elongation.

The average elongation for the three dumb bell specimens in a cylinder is also compared to that of the elastomer immersed in a reference oil to obtain the % change in elongation with respect to the elastomer in the reference oil. An oil is determined to pass this test if "delta" is no larger than 10% and the specimens are free of cracks. The test results are set forth in Table III, below.

EXAMPLE 25

Boration of Ashless Dispersant and Test

The procedure of Example 17 is repeated and 35.0 grams of the solution product of Exampe 17 is blended with 465.0 grams of standard oil 'C'. The resulting dispersant is then subjected to the Caterpillar Viton Test. The test results are reported in Table III, below.

EXAMPLE 26

Boration of Ashless Dispersant

The procedure of Example 17 is repeated except 194.65 grams of the solution product of Example 1, 9.0 grams of a mineral oil having a viscosity of about 100 SUS at 40° C., and 23.30 grams of a super borated Mannich addition product, containing 2.92% boron obtained by reacting in a well known conventional Mannich dispersant prepared from a high molecular weight alkyl ($M_N$ 2250) substituted phenol, formaldehyde, and tetraethylene pentamine, with boric acid, are charged to the reaction vessel.

EXAMPLE 27

Caterpillar Viton Test

The procedure of Example 24 is carried out using the product of Example 26 in place of the product of Example 1. The test results are reported in Table III, below.

EXAMPLE 28

Boration of Ashless Dispersant

The procedure of Example 17 is repeated except 384.0 grams of the solution product of Example 1, 26.0 grams of a mineral oil having a viscosity of about 100 SUS at 40° C., and 44.0 grams of a super borated succinic amide ester containing 2.95% boron are charged to the reaction vessel.

EXAMPLE 29

Caterpillar Viton Test

The procedure of Example 24 is carried out using the product from Example 28. The test results are reported in Table III, below.

EXAMPLE 30

Boration of Ashless Dispersant and Test

The procedure of Example 17 is repeated except 15.0 grams of a succinic amide ester ashless dispersant is blended with 485.0 grams of a standard oil 'C'. The product is then subjected to the Caterpillar Viton Test. The test results are reported in Table III, below.

EXAMPLE 31

Boration of Ashless Dispersant

The procedure of Example 30 is repeated except the succinic amide ester ashless dispersant is replaced by the product of Example 21. The test results are reported in Table III, below.

EXAMPLE 32

Boration of Ashless Dispersant

The procedure of Example 17 is repeated except the apparatus is charged with 175.15 grams of a succinic ester amide ashless dispersant, 31.3 grams of the super borated Mannich addition product (see Example 26) containing 2.92% boron, and 20.55 grams of a mineral oil having a viscosity of about 100 SUS at 40° C.

EXAMPLE 33

The procedure of Example 31 is repeated except the product from Example 21 is replaced by the product from Example 32. The test results are reported in Table III, below.

EXAMPLE 34

The procedure of Example 17 is repeated except the apparatus is charged with 174.0 grams of a succinic amide ester ashless dispersant, 29.6 grams of a super borated succinic amide ester containing 2.95% boron, and 23.4 grams of a mineral oil having a viscosity of about 100 SUS at 40° C.

EXAMPLE 35

The procedure of Example 31 is repeated except the product from Example 21 is replaced by the product from Example 34. The test results are reported in Table III, below.

TABLE III

Caterpillar Viton Test Succinimide Dispersant

| Example | Boron Source | Con. in Disp. | Oil | Delta or % Change |
|---|---|---|---|---|
| 24 | None | 0% | 'C' | 15.6% |
| 25 | Borated Bis-succinimide | 0.3% | 'C' | 4.7% |
| 27 | Borated Mannich | 0.3% | 'C' | 13.3% (13.0%) |
| 29 | Borated Succinicamide ester | 0.3% | 'C' | 10.0% |
| 30 | None | 0% | 'D' | 32.7% |
| 31 | Borated Bis-succinimide | 0.4% | 'D' | 16.3% (17.0%) |
| 33 | Borated Mannich | 0.4% | 'D' | 21.7% |
| 35 | Borated Succinicamide ester | 0.4% | 'D' | 22.7% |

In the above tabulation, the data presented in parenthesis is for a repeat of the example.

What is claimed is:

1. An internal combustion engine lube oil composition which exhibits improved compatibility with engine seals made of fluorine substituted elastomers, said lube oil composition comprising: a major amount of oil of lubricating viscosity and a minor amount, effective for dispersancy, of a borated ashless dispersant, and wherein said lube oil composition is prepared by the steps comprising:

(a) preparing a borated succinimide containing about 1.0 to about 3.0% boron and having the formula:

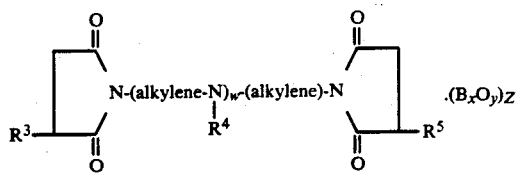

wherein $R^3$ and $R^5$ are polyisobutyl groups containing about 20 to about 165 carbon atoms, the alkylene groups each containing 2 to 8 carbon atoms, inclusive, $R^4$ is hydrogen or alkyl containing 1 to 4 carbon atoms, w is an integer having a value of 0 to 6, x is an integer having a value of 1 to 3, y is an integer having a value of 1 to 3, and z is an integer having a value of 2 to 56; said borated succinimide having a boron-to-nitrogen weight ratio of about 0.20 to about 65 and wherein said preparation of the borated succinimide is carried out by reacting a succinimide having the formula:

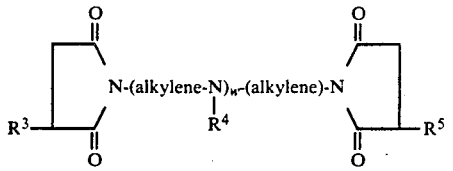

wherein $R^3$, $R^4$, $R^5$ and w are as defined above, with boric acid in the presence of water at a temperature of about 177° C. to about 204° C. for a reaction period of about one hour to about 24 hours;

(b) utilizing the borated succinimide prepared in step (a) above as a borating agent to borate a non-borated ashless dispersant by blending about 7 to about 235 parts by weight of said borated succinimide obtained in step (a) with about 100 parts of a mixture which comprises diluent oil plus non-borated ashless dispersant; and (c) blending the product obtained in step (b) into a lubricating oil composition containing components suitable for an internal combustion engine.

2. The lube oil composition of claim 1 wherein the reaction temperature used in step (a) for preparation of said borated succinimide is in the range of about 182° C. to about 204° C.

3. The lube oil composition of claim 1 wherein the polyisobutyl groups $R^3$ and $R^5$ have number average molecular weights in the range of about 1200 to about 2300, and wherein the boron content of the borated succinimide obtained in step (a) is about 1.9 to about 2.1%.

4. A method for preparing an internal combustion engine lube oil composition having improved compatibility toward engine seals made of fluorine substituted elastomers which method comprises:

(a) blending (i) about 7 to about 235 parts by weight of a borated succinimide containing about 1.0 to about 3.0% boron and having the formula:

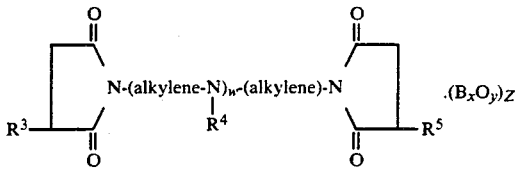

wherein $R^3$ and $R^5$ are polyisobutyl groups containing about 20 to about 165 carbon atoms, the alkylene groups each containing 2 to 8 carbon atoms, inclusive, $R^4$ is hydrogen or alkyl containing 1 to 4 carbon atoms, w is an integer having a value of 0 to 6, x is an integer having a value of 1 to 3, y is an integer having a value of 1 to 3, and z is an integer having a value of 2 to 56; said borated succinimide having a boron-to-nitrogen weight ratio of about 0.20 to about 65; with (ii) about 100 parts of a mixture which comprises diluent oil plus non-borated ashless dispersant; and (b) blending the product obtained in step (a) into a lubricating oil composition containing components suitable for an internal combustion engine.

* * * * *